US009713403B2

(12) United States Patent
Taft

(10) Patent No.: US 9,713,403 B2
(45) Date of Patent: Jul. 25, 2017

(54) BABY BIDET AND CHANGING TABLE

(71) Applicant: Nils C. Taft, Spring, TX (US)

(72) Inventor: Nils C. Taft, Spring, TX (US)

( * ) Notice: Subject to any disclaimer, the term of this patent is extended or adjusted under 35 U.S.C. 154(b) by 0 days.

(21) Appl. No.: 13/951,047

(22) Filed: Jul. 25, 2013

(65) Prior Publication Data

US 2017/0105583 A1 Apr. 20, 2017

(51) Int. Cl.

| | |
|---|---|
| ***A47K 3/024*** | (2006.01) |
| ***A47D 5/00*** | (2006.01) |
| ***A47K 3/12*** | (2006.01) |
| ***A47K 3/26*** | (2006.01) |

(52) U.S. Cl.

CPC ..... *A47K 3/024* (2013.01); *A47D 5/00* (2013.01); *A47K 3/127* (2013.01); *A47K 3/26* (2013.01)

(58) Field of Classification Search

CPC ..... A47K 3/127
USPC ..... 4/572.1, 538, 619
See application file for complete search history.

(56) References Cited

U.S. PATENT DOCUMENTS 1,490,028 A * 4/1924 William ..... A47D 5/00 312/228
3,039,117 A * 6/1962 Amalie ..... A47K 3/03 4/239
3,094,711 A * 6/1963 Kentes ..... A47K 3/064 4/550
3,490,079 A * 1/1970 Stolbach ..... A47K 3/26 4/420.3
3,577,567 A * 5/1971 Wintercorn ..... E03D 9/085 4/420.1
3,654,636 A * 4/1972 Restyanszki ..... E03D 9/085 4/445
3,916,453 A * 11/1975 Dominguez-Armada ..... A61M 3/0225 4/445
4,152,788 A * 5/1979 Gomes ..... A47K 3/26 4/445
4,881,281 A * 11/1989 Lavoine ..... A47K 3/074 4/572.1
5,067,186 A * 11/1991 Ayers ..... A47D 5/003 4/420.3
5,361,427 A * 11/1994 Wilk ..... E03D 9/085 4/420.3
5,636,391 A * 6/1997 Greene, III ..... A47K 3/034 4/420.3
7,305,724 B2 * 12/2007 Rozental ..... A47K 3/074 4/572.1
7,533,425 B2 * 5/2009 Monti ..... A47K 3/024 4/572.1
8,117,689 B2 * 2/2012 Slayton ..... A47K 1/02 4/516

(Continued)

*Primary Examiner* — Lori Baker
(74) *Attorney, Agent, or Firm* — James L. Jackson

(57) ABSTRACT

A completely self-contained baby bidet and changing table system that is completely portable and is adapted for use in domestic or commercial environments. A cabinet structure has a washing basin with a drain tube connecting the washing basin with a removable waste water tank. A removable clean water reservoir is located within the cabinet and has a pump, heater, water supply hose and spray nozzle for delivery of clean and heated water spray to the body of an infant. Padded, waterproof mats support the infant so that water used for washing is drained into the washing basin and is then conducted to the waste water tank by a drain tube.

16 Claims, 3 Drawing Sheets

(56) References Cited

U.S. PATENT DOCUMENTS

| | | | | |
|---|---|---|---|---|
| 8,966,677 | B1 * | 3/2015 | Leihgeber | A47K 3/024 4/572.1 |
| 9,066,632 | B2 * | 6/2015 | Millerd | A47K 3/02 |
| 2004/0139543 | A1 * | 7/2004 | Courouzos | A47K 3/074 4/572.1 |
| 2014/0325750 | A1 * | 11/2014 | Anyika | A47K 3/024 4/548 |

* cited by examiner

BABY BIDET AND CHANGING TABLE

RELATED PROVISIONAL APPLICATION

Applicant hereby claims the benefit of U.S. Provisional Patent Application No. 61/796,588, filed on Nov. 15, 2012 by Nils C. Taft and entitled "Baby Bidet and Changing Table", which provisional application is incorporated by reference herein for all purposes.

BACKGROUND OF THE INVENTION

Field of the Invention

The present invention relates generally to a completely self-contained changing table apparatus and systems for supporting an infant during changing of diapers or other articles of clothing. More particularly, the present invention concerns a self-contained changing table apparatus that provides for efficient cleaning of the pelvic region of an infant, such as when the infant is determined to have wet or soiled diapers. This invention also concerns changing table apparatus having a self-contained clean water supply and a washing basin for washing desired portions of the body of an infant with soap and water to provide for a condition of cleanliness in association with changing the diapers of an infant and a waste water collection system for collection and disposal of waste water.

Description of the Prior Art

Many different types of infant changing tables have been developed for use in homes and for use in commercial facilities such as the restrooms of service station facilities, restaurants and article sales facilities, such as clothing stores, department stores and the like. It is well known, however, that the pelvic region of an infant often becomes soiled to the point that washing the soiled region of the infant with soap and water becomes highly desirable. If this soiled body condition occurs during conditions of travel or when the parent and infant are away from home and are in a commercial establishment, washing of the infant's pelvic region with soap and water is often not practical. In such case, the parent usually employs a liquid such as water or a lotion to dilute the contaminant material and then uses paper or fabric towel material to wipe away as much of the contaminant material as is possible. At times the contaminated region of the infant's body is treated with a lotion several times to ensure that virtually all of the contaminant material has been removed, thus preventing damage to the skin tissue of the infant by residual contaminant material. If a supply of water is available, such as when a changing table is located in a restroom area, the parent will often dampen a towel with water and use the dampened towel to dilute the contaminant material and remove it from the skin tissue of the infant.

Since washing of the pelvic region of an infant is well known to be highly desirable, various devices and systems have also been developed to permit support of an infant for diaper changing and to permit washing of the infant. The infant washing devices that are known are typically connected with the plumbing systems of a bath room or toilet facility so that waste water can be conducted directly into a toilet bowl for disposal. It is therefore considered desirable to provide a baby bidet changing table that is completely portable and self-contained so that it may be positioned at any location within or near a bath room or toilet facility, without any necessity for alteration of the plumbing system that is used for clean water supply or waste water disposal. It is also considered desirable to provide a baby bidet system that can easily be moved, so that it can be positioned within any sort of room for simple and efficient use and can then be easily moved to another location or to a storage area where it will not interfere with other activities for which the space is needed.

Baby bidets have been developed in the past, for use in washing all or parts of the body of an infant as desired. One example is presented in U.S. Pat. No. 5,636,391 of Greene, which employs a permanent water supply having a flexible water supply line to which a spray nozzle is connected. A toilet T includes a baby bidet mechanism having an infant support 20. Another example of a baby bidet is shown by U.S. Pat. No. 5,067,186 of Ayers. A baby bathinette of some interest to the present invention is shown by U.S. Pat. No. 7,305,724 of Rozental, et al. These baby bidet or bathinette systems are generally permanently mounted to or incorporated with a toilet facility, thus requiring modification of a toilet or bathroom water supply and disposal facility. As such, they are not capable of being stored away when not needed and moved to a desired position for use.

SUMMARY OF THE INVENTION

It is a principal feature of the present invention to provide a novel, completely portable baby bidet and changing system that has the capability of providing efficient and secure support for an infant during diaper changing activities and has onboard water supply, a clean water distribution system and a waste water collection system. The baby bidet system incorporates apparatus enabling simple and efficient washing of an infant as necessary to provide for sanitary skin tissue conditions to promote the health and well-being of the infant.

It is another feature of the present invention to provide a novel self-contained baby bidet system that can be moved as needed for simple and efficient use and for out of the way positioning when not being used. The portability and self-contained nature of the baby bidet system facilitates simple and efficient installation without any need for connection to or alteration of the plumbing system of the facility within which the baby bidet system is located.

Briefly, the various objects and features of the present invention are realized through the provision of a completely self-contained baby bidet system having a cabinet that is easily moveable within a room as desired and defines a changing table or surface section that provides safe and efficient support of an infant during diaper changing and infant washing activities. The cabinet structure is provided with an on-board clean water supply reservoir that is removable for refilling or can be refilled on site. The clean water supply provides a sufficient volume of water to permit several baby cleaning and changing activities to take place without requiring refilling. When refilling of the water supply reservoir is necessary, the user of the system will typically employ a reservoir filling container that is easily filled from any suitable water source. The filled container can then be transported to the baby bidet system and used to fill the clean water reservoir. The clean water reservoir is positioned on a support shelf within the cabinet and can be moved from the shelf, filled with water and again placed on the support shelf. Typically, the clean water reservoir will be composed of a light weight material such as a suitable polymer, though it can be composed of any suitable metal material if desired.

The clean water supply reservoir has an electrically energized clean water supply pump that is typically located within the clean water reservoir with its suction in communication with the water within the reservoir. The pump has a flexible water supply hose or conduit that is connected with the pump discharge and has an adjustable spray control valve and nozzle at its distal end. The adjustable spray control valve is typically of the lever or button actuated variety and is manually operated to achieve controlled distribution of water on selected parts of the body of the infant, particularly the pelvic region which often becomes soiled. Any other type of water control valve, such as a valve having a manually operated rotary actuator, may be employed within the spirit and scope of this invention. An electrically energized water heater is also located within the water of the clean water reservoir and maintain the water within the clean water supply reservoir at a predetermined temperature for the comfort of an infant being washed and changed. The water pump and the water heater are simply placed within the water of the reservoir and rest on the bottom wall of the reservoir tank or container. The water pump and the water heater are removed from the reservoir when the reservoir is to be removed from the cabinet for refilling. The clean water reservoir can also be replenished with water from any suitable water container or water source.

Panels of the baby changing platform in or near the region where the pelvic region of an infant is intended to rest, are removable to expose a washing basin beneath the platform. Water from the flexible washing hose and nozzle can be sprayed or distributed onto the pelvic region of the infant to permit simple and efficient cleaning and sanitary maintenance of the infant. The contaminated water from the baby washing activity will drain from the body of the infant into the washing basin and will drain from the basin to a waste water collection tank or vessel via a drain opening of the washing basin and a drain tube. The waste water collection tank or vessel is located on a lower or bottom support shelf of the cabinet so that contaminated water from the washing basin will flow by gravity form the washing basin to the waste water collection tank. The user of the baby bidet system will then remove the tank or vessel of collected contaminated water from the cabinet and pour the waste water into a toilet or other disposal facility. Neither the clean water supply or the waste water collection system are permanently or temporarily connected with the plumbing system of the bath room or restroom facility of a home or building. This feature permits the cabinet to be easily stored away when not needed and moved to a desired location when needed, without requiring any modification of a permanent water supply or waste water disposal system.

The cabinet of the baby bidet and changing system is provided with internal shelving on which may be supported a supply of clean diapers, baby clothing, soap or detergent, baby lotion, etc. that may be used for washing of an infant. A diaper disposal container may also be located on the internal shelving of the cabinet to receive and store soiled diapers for periodic disposal, and other items that are suitable for diaper changing and infant washing. The clean water reservoir and the waste water tank or container are each supported by internal shelving of the cabinet and are removable from the shelving for resupply of clean water and for disposal of collected waste water. During an infant cleaning and dressing procedure, it is expected that only about a quart of water will typically be used. Thus, clean water and waste water handling will be quite simple and easily accomplished.

The baby bidet changing table of the present invention is completely portable and self-contained in that it has a clean water supply and a pump, water hose and spray nozzle for distribution of water to the body of an infant as needed for thorough washing of the infant. The waste water of the cleaning process is collected by a washing basin and is then drained to a waste water collection tank. These features ensure that the baby bidet changing table may be moved from place to place, since it has no connection whatever with the plumbing system of a conventional bathroom facility. The baby bidet changing table of the present invention may be efficiently utilized in the domestic environment of homes or may be used in commercial establishments, such as restaurants, automotive service stations and in commercial buildings where infants will be present from time to time.

BRIEF DESCRIPTION OF THE DRAWINGS

So that the manner in which the above recited features, advantages and objects of the present invention are attained and can be understood in detail, a more particular description of the invention, briefly summarized above, may be had by reference to the preferred embodiment thereof which is illustrated in the appended drawings, which drawings are incorporated as a part hereof.

It is to be noted however, that the appended drawings illustrate only a typical embodiment of this invention and are therefore not to be considered limiting of its scope, for the invention may admit to other equally effective embodiments.

In the Drawings:

FIG. 1 is an isometric illustration showing a baby bidet and changing system that is constructed according to the principles of the present invention and represents the preferred embodiment of the invention;

FIG. 2 is an isometric illustration showing the top of the baby bidet and changing system of FIG. 1 in greater detail, with baby clothing illustrating the position of a baby supported thereby, and showing the washing basin of the baby bidet changing system with its cover removed for baby washing activity;

Figure 3:
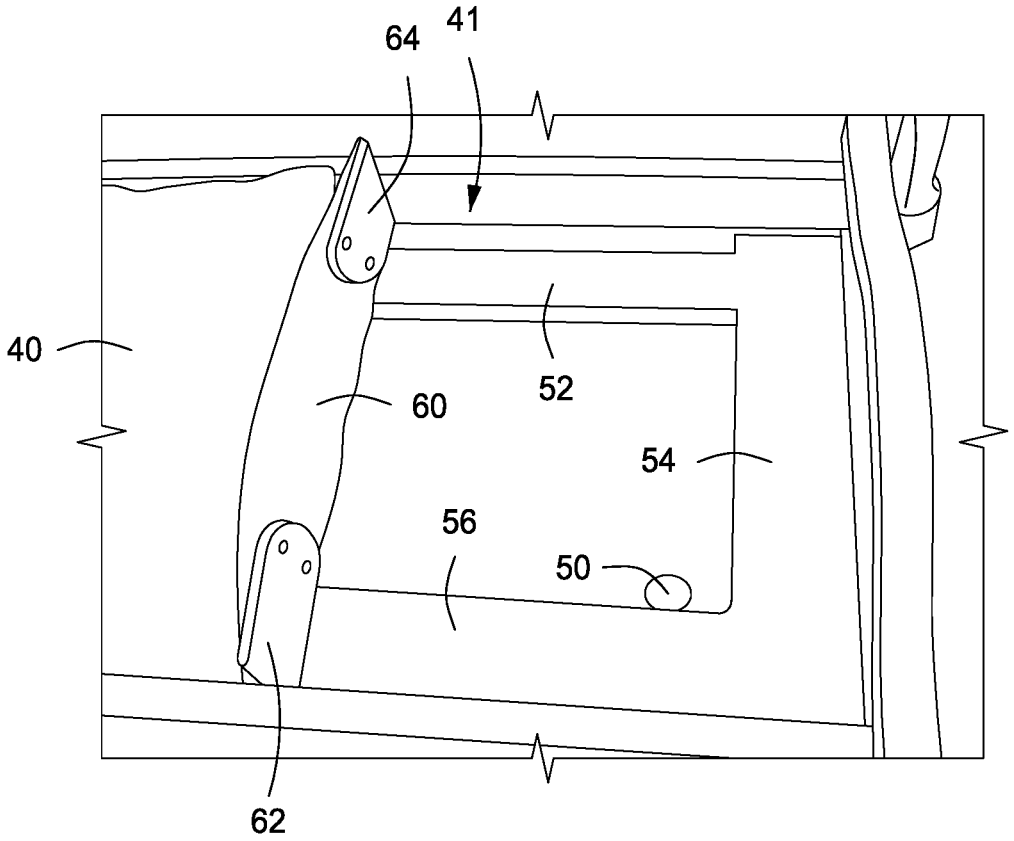
Figure 4:
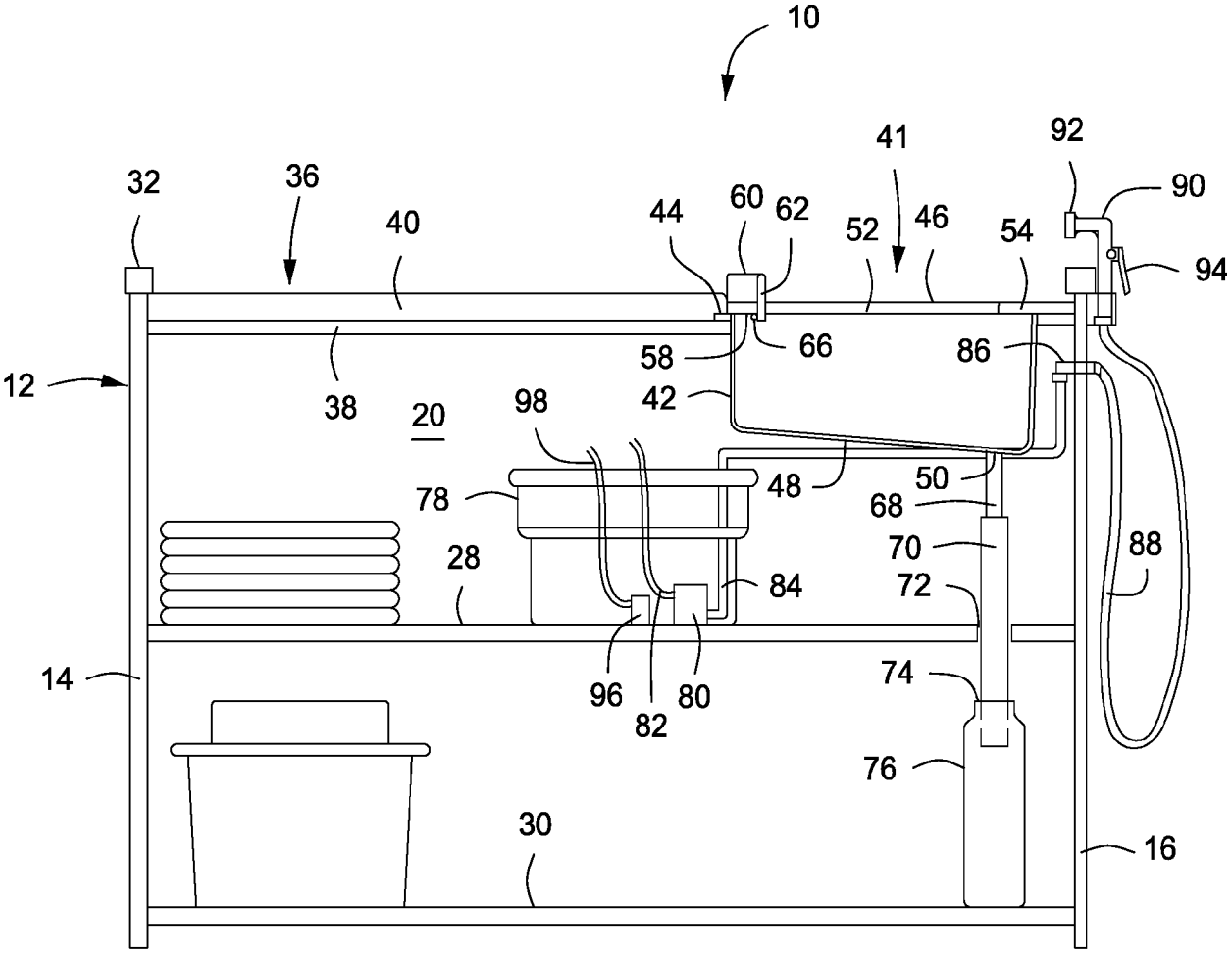

FIG. 3 is an enlarged isometric illustration showing support of a padded bumper in relation with the washing basin and showing padded waterproof support members positioned about the periphery of the washing basin for the support and comfort of a baby during washing activity; and FIG. 4 is a front elevation view of the baby bidet and changing system, as it would appear with the doors open and further showing the washing basin, clean water reservoir and waste water drain and collection system in detail.

DETAILED DESCRIPTION OF PREFERRED EMBODIMENT

Figure 1:
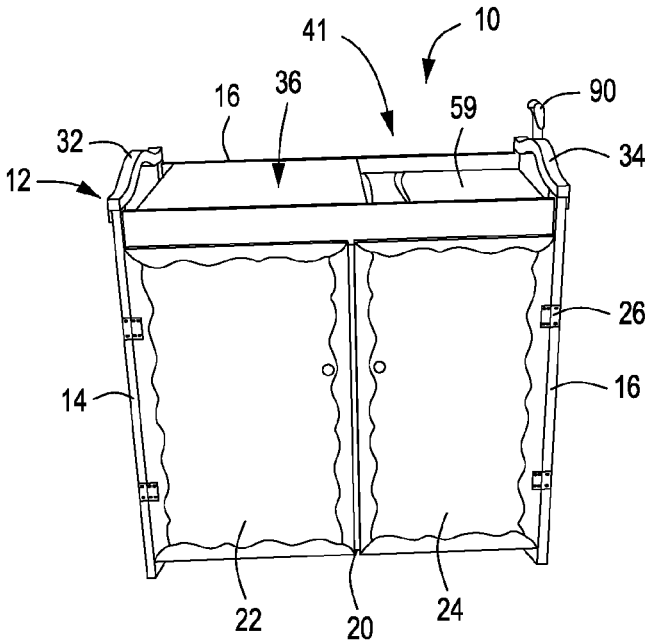
Figure 2:
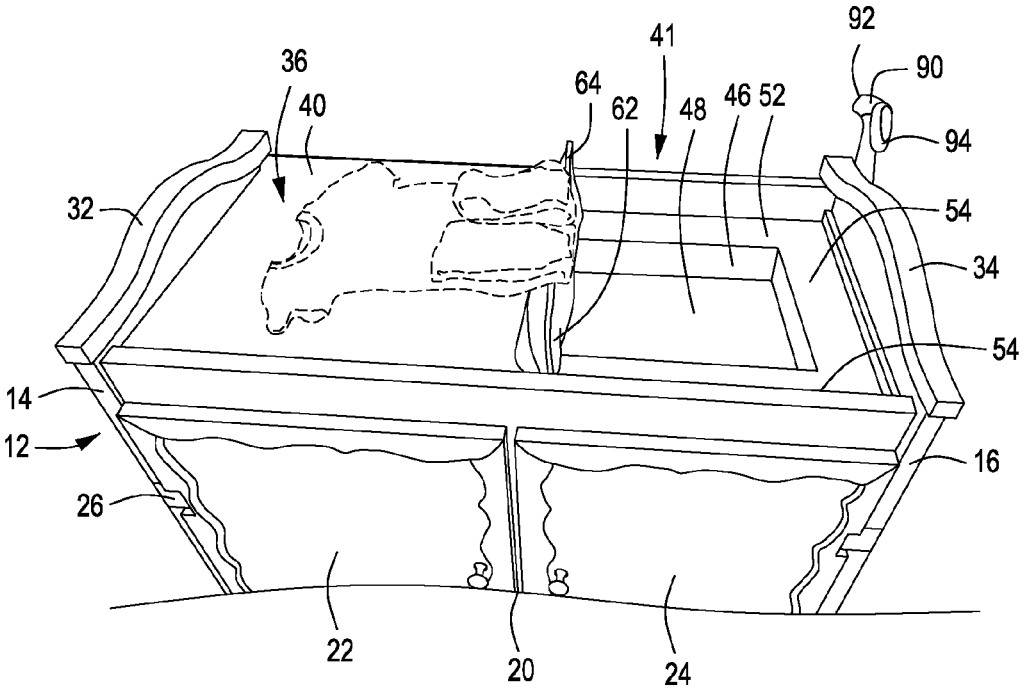

Referring now to the drawings and first to FIG. 1, a baby bidet and changing table, representing the preferred embodiment of the present invention is shown generally at 10 and comprises a cabinet shown generally at 12 which has side walls 14 and 16 and a back wall panel 18. The cabinet 12 defines a front opening 20 which is normally closed by a pair of cabinet doors 22 and 24 which are mounted to the cabinet structure by hinges 26. Within the cabinet 12 is mounted at least one intermediate support shelf 28 for support of a clean and heated water supply and, if desired, for support of diapers and other infant clothing and for storage of various products that are used in connection with washing, drying and other treatment of a baby. The cabinet structure also defines a bottom wall 30 which will also serve as a storage panel for various other items, such as baby clothing baby blankets and the like. The bottom wall of the cabinet also serves as a support for a waste water receptacle as will be explained in detail below. The side walls 14 and 16 of the cabinet have upper portions 32 and 34 that project upwardly and serve as end walls of a baby changing table area, shown generally at 36. The cabinet includes a top panel 38 having sufficient structural integrity for support of an infant and for support of other apparatus of the changing table system. A removable waterproof and padded changing pad 40 is positioned on the top panel 38 for the comfort of the infant during changing and washing activities. Infant clothing, not being a part of the present invention, is shown in broken line in FIG. 2 in much the same position as an infant during diaper changing and washing of the pelvic region of the infant.

A bidet section shown generally at 41 includes a washing basin 42 which is mounted to the underside of the top panel 38 of the cabinet 12 by means of a peripheral basin flange 44 that rests on the upper surface of the top panel. The washing basin is of generally rectangular configuration as shown, and defines a generally rectangular opening 46, but may be of any suitable configuration without departing from the spirit and scope of the present invention. The washing basin 42 defines a bottom wall 48 that slopes to a basin drain opening 50 that is located at a corner region of the basin. The rectangular opening 46 of the washing basin 42 is strategically located so that the legs and desired portions of the pelvic region of an infant lying on the changing table will extend over the washing basin, thus permitting waste water to drain from the infant into the washing basin.

Padded waterproof support members 52, 54, 56 and 58 are supported by the top panel 38 of the cabinet and may be fixed to the top panel if desired. These padded waterproof support members serve as cushioning supports for the legs of an infant being washed. A generally rectangular padded cover member 59 is positioned over the washing basin when the washing basin is not being used, with its peripheral portions engaging and being supported by the waterproof support members 52, 54, 56 and 58.

The bidet section 41 also includes a waterproof padded bumper 60 positioned transversely across one end of the changing table area 36 and projecting above the top surface of the changing area and serving to minimize the potential for water movement from the washing basin or from the infant along the top surface of the changing area. With an infant lying in the position of the infant clothing shown in broken line in FIG. 2 the pelvic region or bottom of the infant will be resting on the waterproof padded bumper 60, establishing a substantial water seal between the waterproof padded bumper 60 and the skin tissue of the infant. Any water that drains from the infant during washing of the pelvic region will descend into the washing basin. The waterproof padded bumper 60 is retained in place by a pair of spaced bumper retainer members 62 and 64, each being supported by hinges. The bumper retainer members 62 and 64 are spaced apart, thus permitting the legs of the infant to extend over the washing basin. The bumper retainer members are angulated away from the washing basin for securing the waterproof padded bumper 60. The bumper retainer members 62 and 64 may be composed of any of a wide range of substantially rigid materials, such as metal, wood, polymer or any suitable combination thereof. Hinge members 66 establish pivotal support of the bumper retainer members 62 and 64 in relation to the top panel 38 of the cabinet structure A drain tube having an upper drain tube section 68 and a lower drain tube section 70 extends downwardly from the bottom opening 50 of the washing basin 42, with the lower drain tube section extending through an opening 72 of the intermediate support shelf 28. The upper drain tube section 68 and a lower drain tube section 70 extends downwardly from the bottom opening 50 of the washing basin 42, with the lower drain tube section extending through an opening 72 of the intermediate support shelf 28. The upper drain tube section 68 may be composed of metal or polymer plumbing drain tubing or the like and the lower drain tube section 70 may be composed of a more flexible tubing such as flexible polymer tubing. The lower end of the lower drain tube section 70 is positioned to be received within the upper opening 74 of a waste water collection tank or receptacle 76 that is typically supported by the bottom wall 30 of the cabinet. This feature permits the waste water draining from the infant during washing to be collected by the waste water collection tank. The waste water collection tank 76 is easily removed from the bottom wall 30 of the cabinet so that the collected waste water can be poured into a toilet bowl of a restroom facility or into any other suitable receptacle for disposal. The waste water collection tank or container need only be large enough to contain the small amount of water that is used to wash the pelvic region of the infant and may be provided with graduated markings for measurement. The waste water container may be in the form of a bottle having a screw cap in the event it should be desirable to retain the waste water for inspection or testing.

A clean water reservoir 78 is preferably supported by the intermediate support shelf 28 such as by simply resting on the shelf, so that the clean water reservoir can be easily removable from the cabinet for efficiency of filling from the water supply of a conventional lavatory. Alternatively, the clean water reservoir may be directly mounted to the top panel intermediate support shelf 28 or mounted to any other interior structure of the cabinet if desired and may be filled in place by means of a suitable water handling container. The portable or moveable nature of the baby bidet and changing table is maintained by providing efficient means for filling the clean water reservoir, rather than providing a more permanent connection with the water supply of the restroom or bathroom of a building facility. Alternatively, if desired, the clean water reservoir may be filled in place, such as by using a flexible fill tube or by pouring clean water through a fill opening of the cabinet. However, it is a feature of the present invention to provide a baby bidet and changing table system that is not permanently connected with the clean water or waste water handling systems of a dwelling or business establishment, thereby permitting the baby bidet and changing system to be readily moveable to a desired position for use or positioned in an out of the way place when it is not being used.

An electrically energized water pump 80 is located within the clean water reservoir 78 simply by resting on the bottom of the reservoir vessel. An electrical supply conductor 82 extends from the water pump 80 and is connected with an electrical supply, not shown. The water pump 80 may be of the type that is widely utilized in fish tanks and incorporates a safety feature that automatically and substantially instantly de-energizes the pump in the event a predetermined electrical current is detected by the pump mechanism. For example, the pump incorporates a ground pin or system that automatically shuts down the electrical supply of the pump within 25 milliseconds upon detection of electrical current within the clean water reservoir. The water pump 80 has a suction opening in communication with the water inside the clean water reservoir and has its pressurized water supply discharge connected with a discharge conduit 84 that is of flexible nature, permitting the water pump to be removed from the clean water reservoir so that the reservoir can be removed from the cabinet and carried to a suitable site for refilling. The clean water discharge conduit has a water discharge connection 86 that penetrates a side wall 16 of the cabinet. A flexible water supply tube 88 extends from the water discharge connection 86 and is connected with a valve controlled water spray unit 90 that has a spray head 92 from which water is sprayed onto selected parts of the infant as desired. The spray unit 90 is provided with a valve operator member 94 that is manually actuated to control the spray of water. The pump pressure output or the spray unit are selectively adjustable to provide a gentle spray of water from the spray nozzle 92.

For the comfort of an infant being washed and changed, an electrically energized water heater 96 is located within the clean water reservoir 78 and is energized via an electrical conductor 98. The water heater is provided with a temperature controller that deenergizes the heater when the water temperature reaches a predetermined optimum.

To prevent any possibility of electrical shock to the infant or the person that is engaged in washing the infant, the electrical power supply system for the pump and for the water heater employs electrical conductors 82 and 98, respectively that are adapted for connection with a standard 110 v ac wall plug and has an electrical circuit including a transformer and ground fault interrupter that is connected with and is arranged to deliver low voltage dc power to the motor of the pump. Other UL approved electrical power systems that are known to be safe when water is present may also be used for this purpose. The discharge pressure of the pump can be adjustable to provide a desired or selected range of fluid pressure at the spray unit 90.

In view of the foregoing it is evident that the present invention is one well adapted to attain all of the objects and features hereinabove set forth, together with other objects and features which are inherent in the apparatus disclosed herein.

As will be readily apparent to those skilled in the art, the present invention may easily be produced in other specific forms without departing from its spirit or essential characteristics. The present embodiment is, therefore, to be considered as merely illustrative and not restrictive, the scope of the invention being indicated by the claims rather than the foregoing description, and all changes which come within the meaning and range of equivalence of the claims are therefore intended to be embraced therein.

I claim:

1. A self-contained baby bidet and changing system, comprising:

a cabinet having a changing table section having a padded and waterproof member for supporting the torso of a baby and having a bidet section for positioning the legs and pelvic region of an infant for washing;

a clean water supply reservoir supported by said cabinet and having a pump delivering clean water from said clean water supply reservoir to a flexible water supply conduit having a manually operated valve controlled clean water spray device;

a washing basin being mounted within said cabinet and being a part of said bidet section and being positioned for receiving waste water resulting from baby washing and having a basin drain;

a waterproof padded member being positioned adjacent said washing basin for engagement by a baby's bottom to provide a substantial seal with the baby's bottom and being oriented to conduct water draining from the baby's bottom into said washing basin, and a waste water collection tank being supported by said cabinet and receiving waste water by gravity from said basin drain.

2. The self-contained baby bidet and changing system of claim 1, comprising:

said clean water supply being a clean water reservoir within said cabinet;

said pump being electrically energized and being located within said clean water reservoir; and said water supply conduit being in communication with said pump and with said manually operated valve controlled clean water spray device.

3. The self-contained baby bidet and changing system of claim 2, comprising:

said pump having an electronic ground system and being automatically de-energized upon sensing of electrical energy within said clean water supply, cabinet receiving waste water from said basin drain.

4. The self-contained baby bidet and changing system of claim 2, comprising:

said water supply conduit having a portion penetrating a wall of said cabinet and having a flexible portion located externally of said cabinet and being of sufficient length for manual movement of said manually operated valve controlled clean water spray device to close proximity with a baby lying on said changing table section.

5. The self-contained baby bidet and changing system of claim 1, comprising:

an electrically energized water heater being removably positioned within said clean water reservoir and heating the clean water to a predetermined temperature for the comfort of a baby being washed.

6. The self-contained baby bidet and changing system of claim 1, comprising:

a bumper retaining member being mounted to said changing table section adjacent said washing basin and supporting said waterproof padded bumper member against inadvertent movement toward said washing basin during baby washing activity.

7. The self-contained baby bidet and changing system of claim 1, comprising:

said clean water supply reservoir and said waste water collection tank each being removable from said cabinet for refilling or emptying.

8. The self-contained baby bidet and changing system of claim 1, comprising:

said washing basin being fixed within said cabinet and being of generally rectangular configuration and defining substantially straight peripheral sections supported by said cabinet; and waterproof padded support members being located along said substantially straight peripheral sections and providing for comfortable support of the legs of a baby in position for washing.

9. A self-contained baby bidet and changing system, comprising:

a cabinet having a changing table section for supporting the torso of a baby and having a bidet section for positioning the legs and pelvic region of an infant for washing;

internal shelving and a bottom support surface being defined by said cabinet;

a clean water reservoir being removably supported by said internal shelving and having an electrically energized pump removably immersed in water within said clean water reservoir;

a water supply conduit being connected with said water supply discharge of said electrically energized pump and incorporating an elongate flexible section located externally of said cabinet and having a manually operated valve controlled clean water spray device for manually controlled application of a gentle spray of water onto the baby;

said bidet section having a washing basin fixed within said cabinet and positioned for receiving waste water draining from the baby during washing activity, said washing basin having a basin drain;

said bidet section also having a waterproof padded member positioned adjacent said washing basin for engagement by a baby's bottom to provide a substantial seal with the baby's bottom and being oriented to conduct waste water draining from the baby's bottom into said washing basin; and a waste water collection tank being removably supported by said cabinet and receiving waste water by gravity from said basin drain.

10. The self-contained baby bidet and changing system of claim 9, comprising:

a padded waterproof basin cover member being selectively positioned over said washing basin for support of the legs of a baby and constituting an enlargement of said changing table and bidet sections.

11. The self-contained baby bidet and changing system of claim 9, comprising:

said pump having an electronic ground fault system and being automatically activated upon sensing of predetermined electrical energy within said clean water supply and deenergizing the electrical circuits of said electrically energized water pump and said electrically energized water heater.

12. The self-contained baby bidet and changing system of claim 9, comprising:

said water supply conduit having a portion penetrating a wall of said cabinet and having a flexible portion located externally of said cabinet and being of sufficient length for manual movement of said manually operated valve controlled clean water spray device to close proximity with a baby lying on said changing table section.

13. The self-contained baby bidet and changing system of claim 9, comprising:

a retaining member being mounted to said changing table section adjacent said washing basin and supporting said waterproof padded member against substantial movement toward said washing basin.

14. The self-contained baby bidet and changing system of claim 9, comprising:

said clean water supply reservoir and said waste water collection tank each being removable from said internal shelving of said cabinet for refilling, cleaning and emptying.

15. The self-contained baby bidet and changing system of claim 9, comprising:

said washing basin being of generally rectangular configuration and defining substantially straight peripheral sections; and waterproof padded support members being located along said substantially straight peripheral sections and providing for comfortable support of the legs of a baby in position for washing.

16. The self-contained baby bidet and changing system of claim 9, comprising:

a padded waterproof basin cover member being selectively positioned over said washing basin for support of the legs of a baby and constituting an enlargement of said changing table section.

* * * * *